US006698759B2

(12) United States Patent
Webb et al.

(10) Patent No.: US 6,698,759 B2
(45) Date of Patent: Mar. 2, 2004

(54) PLAYER BANKED THREE CARD POKER AND ASSOCIATED GAMES

(75) Inventors: Derek J. Webb, Littleover (GB); Roger M. Snow, Las Vegas, NV (US)

(73) Assignee: Shuffle Master, Inc., Las Vegas, NV (US)

( * ) Notice: Subject to any disclaimer, the term of this patent is extended or adjusted under 35 U.S.C. 154(b) by 70 days.

(21) Appl. No.: 10/016,436

(22) Filed: Nov. 1, 2001

(65) Prior Publication Data

US 2002/0153662 A1 Oct. 24, 2002

Related U.S. Application Data

(60) Continuation-in-part of application No. 09/249,118, filed on Feb. 2, 1999, now Pat. No. 6,345,823, which is a continuation-in-part of application No. 09/170,092, filed on Oct. 13, 1998, now Pat. No. 6,237,916, which is a continuation-in-part of application No. 08/889,919, filed on Jul. 10, 1997, now Pat. No. 6,056,641, which is a division of application No. 08/504,023, filed on Jul. 19, 1995, now Pat. No. 5,685,774.

(51) Int. Cl.[7] ..... A63F 1/00

(52) U.S. Cl. ..... 273/292; 273/274; 273/309; 463/13

(58) Field of Search ..... 273/292, 274, 273/309; 463/12, 13

(56) References Cited

U.S. PATENT DOCUMENTS

| | | | | |
|---|---|---|---|---|
| 4,743,022 A | | 5/1988 | Wood | |
| 4,836,553 A | | 6/1989 | Suttle et al. | |
| 4,861,041 A | | 8/1989 | Jones et al. | |
| 5,022,653 A | | 6/1991 | Suttle et al. | |
| 5,046,736 A | | 9/1991 | Bridgeman et al. | |
| 5,098,107 A | | 3/1992 | Boylan et al. | |
| 5,174,579 A | | 12/1992 | Griffiths | |
| 5,257,784 A | | 11/1993 | Boylan et al. | |
| 5,257,810 A | | 11/1993 | Schorr et al. | |
| 5,265,877 A | | 11/1993 | Boylan et al. | |
| 5,275,415 A | | 1/1994 | Wisted | |
| 5,288,081 A | | 2/1994 | Breeding | |
| 5,294,128 A | | 3/1994 | Marquez | |
| 5,308,065 A | | 5/1994 | Bridgeman et al. | |
| 5,366,228 A | * | 11/1994 | Kangsanaraks | 273/292 |
| 5,377,973 A | | 1/1995 | Jones et al. | |
| 5,397,128 A | | 3/1995 | Hesse et al. | |

(List continued on next page.)

FOREIGN PATENT DOCUMENTS

GB 667345 2/1952

OTHER PUBLICATIONS

"Three–Card Poker", "Three–Card Monte", "Brag", Scarne's Encylcopedia of Games, John Scarne, Harper & Row Publishers, p 28–31, 1973.*

(List continued on next page.)

*Primary Examiner*—Benjamin H. Layno
(74) *Attorney, Agent, or Firm*—Mark A. Litman & Assoc. P.A.

(57) ABSTRACT

A casino wagering game, comprises 1) placing a wager to participate in the game; 2) a dealer dealing a hand of three cards to each player who placed a wager; 3) resolving the player hands against a plurality of predetermined winning poker outcomes; and 4) paying each player odds whose hand consists of a predetermined winning outcome. The present invention comprises a casino style wagering game against a dealer, comprising the steps of placing a wager, dealing a three card poker hand to each player, dealing at least three cards to the dealer, and paying the player on the bet when a poker rank of his hand exceeds the rank of a dealer's hand. In a preferred form of the invention, the hierarchy of poker hand ranking differs from that of standard five card poker.

48 Claims, 1 Drawing Sheet

U.S. PATENT DOCUMENTS 5,431,408 A 7/1995 Adams
5,489,101 A 2/1996 Moody
5,505,449 A 4/1996 Eberhardt et al.
5,531,448 A 7/1996 Moody
5,538,252 A 7/1996 Green
5,584,486 A 12/1996 Franklin
5,597,162 A * 1/1997 Franklin ..... 273/292
5,630,757 A 5/1997 Gagin et al.
5,653,444 A 8/1997 Dahl
5,673,917 A 10/1997 Vancura
5,685,774 A 11/1997 Webb
5,732,950 A 3/1998 Moody
5,762,340 A * 6/1998 Feola ..... 273/292

OTHER PUBLICATIONS

Copyright filing with the Bureau voor de Intellectuele Eigendom, Aruba, 13 pgs (Jan. 13, 1998).

Published Rule Sheet for Casino Poker from Vegas World, 1 page (1982).

"Card Craps", Scarne's Encyclopedia of Card Games, pp. 321–323, (1948) Three Card Poker Disclosure by Derek J. Webb.

* cited by examiner

PLAYER BANKED THREE CARD POKER AND ASSOCIATED GAMES

RELATED APPLICATIONS

This application is a continuation-in-part of U.S. patent application Ser. No. 09/249,118 filed Feb. 12, 1999 now U.S. Pat. No. 6,345,823 which in turn is a continuation-in-part of U.S. patent application Ser. No. 09/170,092 filed Oct. 13, 1998, now U.S. Pat. No. 6,237,916 issued May 29, 2001, which is a continuation-in-part of U.S. patent application Ser. No. 08/889,919 filed Jul. 10, 1997 now U.S. Pat. No. 6,056,641 issued May 2, 2000, which is a division of U.S. patent application Ser. No. 08/504,023 filed Jul. 19, 1995, now U.S. Pat. No. 5,685,774 issued Nov. 11, 1997, which claims priority under 35 U.S.C. 119 from United Kingdom Patent Applications 94/26324 filed Dec. 29, 1994 and 94/14822 filed Jul. 22, 1994.

BACKGROUND OF THE INVENTION

1. Field of the Invention

The present invention relates to games, more particularly to card-type games that are suitable for use in gaming establishments, and more particularly to poker-type card games that are suitable for use in gaming establishments.

2. Background of the Art

Casinos and leisure establishments continually require new games to offer their clientele. Such games are generally required to enable each player to play against a banker (who usually also acts as dealer) provided by the casino, rather than against other players. Alternatively, in a "card room" game each player may have the option to act as banker, whilst the establishment runs the game on behalf of the banker and takes fees from the players.

Players typically enjoy games which can be played rapidly and which offer players a plurality of choices. A plurality of choices heightens player interest in games. It would therefore be desirable to provide card games comprising a plurality of new wagering options.

Let it Ride Bonus® Stud Poker, as disclosed in Breeding U.S. patent application Ser. No. 09/495,149 filed on Jan. 31, 2000 entitled MULTI-TIERED WAGERING METHOD AND GAME, the content of which is hereby incorporated by reference, describes a primary card game in which the player plays a 5 card poker game. In the base game, a player makes a three part wager on the occurrence of one of a number of predetermined winning hands. Each player is dealt three cards, and the dealer is also dealt three cards. One dealer card is discarded, and the other two cards are placed face down on the table. The player may withdraw a first portion of his bet after he has examined his partial three-card hand. The community cards are used by each player to form a five card hand. After the dealer turns the first community card face up, the player is given the opportunity to withdraw a second portion of his bet. The third bet must remain at risk.

Standard poker rankings are used to determine the hierarchy of payouts. The hands that pay (highest to lowest) in a typical LET IT RIDE® basic game are: royal flush, straight flush, four of a kind, full house, flush, straight, three of a kind, two pair, and a pair. Each winning hand pays odds, and all winning outcomes and corresponding payout odds are listed in a pay table. Optionally, the player can place a side bet on the occurrence of certain high ranking hands within the predetermined winning outcomes in the base game. Both the player cards and the dealer's common cards are used to define the player's hand and corresponding hand ranking in the side bet game. Players are required to make a multiple part bet, and can optionally withdraw part of the bet upon viewing some of the cards.

It would be desirable to provide a poker-style game with simplified betting structure and dealing procedures that provides a player with sufficient betting options to maintain player interest, and follows the rules of poker, as poker rules are well known throughout the world.

SUMMARY OF THE INVENTION

In one form of the invention, a casino wagering game is provided that this disclosure comprises the steps of: 1) placing a single part wager to participate in the game; 2) a dealer dealing a hand of three cards to each player who placed a wager; and 3) resolving the player hands according to a predetermined hierarchy of poker hands. In one form of the invention, the hands are resolved against a pay table of predetermined winning poker outcomes and corresponding odds. Players are paid odds (payouts that are multiples of an amount wagered) when their hand consists of a predetermined winning outcome. This form of the invention is referred to as "the game against the pay table."

In a preferred form of the invention, the game is played as a live casino card game with physical cards, comprising the steps of: placing a single part wager to participate in a casino wagering three-card poker type game; dealing a hand consisting of three cards to each player who placed a single part wager; and resolving each player's hand according to the rules of poker against a payout table providing payouts for predetermined ranks of poker-type hands; wherein at least some of the payouts are proportional to the single part wager in resolving hands.

The present invention is also a method of playing a casino card game utilizing a standard deck of cards, comprising the steps of: placing a wager to participate in a three card poker game against a dealer; dealing three cards to the player; dealing at least three cards to the dealer; and resolving the hands according to the standard rules of poker. For purposes of this disclosure, this form of the invention is referred to as "the game against the dealer."

The three card hand against a pay table may be played individually, or in combination with a three card game against a dealer. The three card game against the dealer may be played individually, or in combination with a three card game against a pay table. The bets on each segment of the game may be mandatory, or optional. Bets on both games are mandatory in one example of the invention.

Other examples of the invention include playing one or more of the three card games in combination with other game segments as well. For example, in combination with placing a wager on a three card hand against a pay table, the player can bet one or more additional wagers on the occurrence of a five card poker hand, where the player receives at least two additional cards after the resolution of the three card hand, either in the form of dealt cards, dealer hand cards or common cards.

The three card poker game play methods of the present invention may be practiced as house banked games, or player banked games. When a game is house banked, the dealer is also the banker. When a game is player banked, the house provides a dealer, and the players take turns acting as banker. The house takes a commission either at a flat rate, or takes a percentage of bets placed.

BRIEF DESCRIPTION OF THE DRAWINGS

Embodiments of the invention will now be described, by way of example only, with reference to the accompanying drawing, in which.

DETAILED DESCRIPTION OF THE INVENTION

Figure 1:
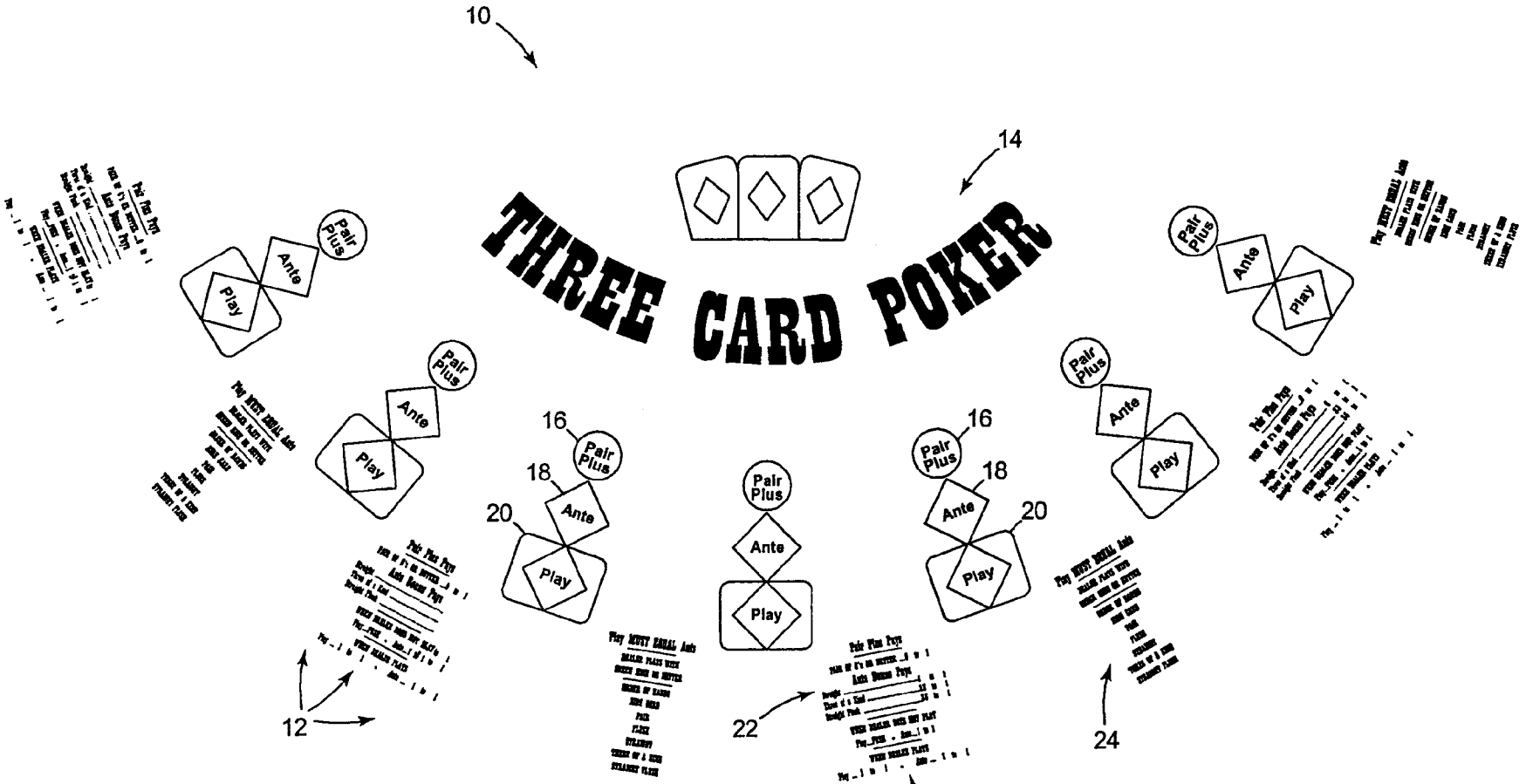
FIG. 1 shows a playing surface for use in playing a card game of one embodiment of the present invention.

One aspect of the invention is a method of playing a wagering game, comprising the steps of: a) placing a single part first wager to participate in a casino three-card poker-type game; b) a dealer dealing a hand consisting of three cards to each player who placed a first wager; and c) resolving each player's hand according to a predetermined hierarchy of poker-type game outcomes. Payouts are preferably made on the first wager when the player obtains a predetermined winning outcome. In one form of the game, all payouts pay odds. That is, all payouts are made in proportion to the amount wagered, with the higher ranking poker hands paying a higher payout multiple than the lower ranking hands. Payouts are made to the player on the first wager for one of a plurality of predetermined winning outcomes. Preferably, all payouts are made in proportion to the first amount wagered.

Payout odds typically are printed on the playing surface and are referred to as a "pay table". One exemplary pay table for a three card poker game of the present invention is outlined below:

| Hand | Payout Odds |
|---|---|
| Straight Flush | 40:1 |
| Three of a Kind | 30:1 |
| Straight | 6:1 |
| Flush | 4:1 |
| Pair | 1:1 |

The standard rules of poker rank hands in the following descending order: Royal flush, straight flush, four of a kind, full house, flush, straight, three of a kind, two pair and a pair. According to a preferred form of the invention, four of a kind, full house and two pair are not included as those outcomes require more than three cards. A royal flush beats a straight flush. In three card picker, the order of certain hands (flush, straight and three of a kind) is inverted. The change in ranking is dictated by the frequency of occurrence of those hands. Although the minimum winning card combination in this example is a pair, the invention contemplates other minimum hands, such as a single face card or a high ranking pair, such as a pair of 10's or better. Proportional payouts are typically between 1:1 and 100:1 against the first single part wager, although other payout schemes are contemplated.

In another form of the invention, at least one but fewer than all payouts are proportional to the single part wager. Payout methods may include fixed amounts (regardless of the amount wagered), odds payouts (payment of the amount wagered times the pay table multiple), a percentage of a jackpot or a jackpot amount. The pay table may contain one or a combination of different payout methods, according to the invention.

One method of the invention comprises the player placing a second wager to participate in a game against the dealer, wherein the dealer also preferably receives a hand of at least three cards. Preferably, the dealer is dealt a three card hand. It might be necessary to increase house odds, depending upon the specific game rules selected. This can be easily accomplished by dealing one or more extra cards to the dealer, and allowing the dealer to use his or her best three card combination in an attempt to beat the player hands. The second wager may optional or mandatory. In fact, the first wager may also be optional, or both the first wager and the second wager may be mandatory.

According to the invention, the game may be house banked or player banked. When the game is player banked, the house collects a flat commission on each hand at the beginning of play, or collects a percentage of the amount bet, depending upon the gaming regulations of the particular jurisdiction. For example, California card rooms are only permitted to collect a flat commission on each hand. When the game is player banked, players are given the opportunity to bank the game. The player who agrees to bank a hand takes all wagers lost by each player, and must pay all winning payouts. Players typically have the option to bank the game, but are not required to do so. In the state of California, for example, corporations exist that bank the games. An employee of The corporation will play the game and act as banker on behalf of his employer. According to the present invention, the game may be played as a player banked game, or as a traditional house banked casino game.

In one form of the invention, when the player participates in a three card poker game against the dealer, he is required to place an additional third wager to stay in the game. This third wager may be smaller, larger or equal to the amount wagered against the dealer. Preferably, the player is permitted to view his three card hand prior to deciding whether to make the third wager or fold. In another form of the game, the player is optionally permitted to make the third wager after viewing his cards, but is not required to fold if he elects not to make the third wager.

When the player plays a three card poker game against the dealer, it is sometimes preferable to require the dealer to have a qualifying hand. For example, the rules might require the dealer to have at least a single queen (queen high) in order to qualify to play against the player. In one example of the invention, the second and third bets are a push when the dealer does not qualify. In another example of the invention, the second bet pays 1:1 and the third bet is returned when the dealer does not qualify.

In yet another example of the invention, the dealer is required to reveal at least one card to the players, and the players are also permitted to view their own three card hand prior to deciding whether to place the third bet.

When the player wins the game against the dealer, the dealer or banker typically pays 1:1 odds. In other examples of the invention, higher or lower payouts are made on the second bet. In another form of the invention, an additional bonus payout is made when the player's hand against the dealer is one of a predetermined high ranking arrangements of cards. No additional bet is required, and the bonus payout may be paid against the second or third bet or both bets. An exemplary pay table that pays odds on the second and third bets is shown below:

| Hand | Payout Odds |
|---|---|
| Straight Flush | 5:1 |
| Three of a Kind | 3:1 |
| Straight | 1:1 |

In another form of the invention, the dealer and player hands may be combined to form the best three, four, five or six card bonus hand. In one example of the invention, a bonus amount is paid for the best five card hand made from the dealer's and player's three cards each.

Alternatively, an aspect of the invention may be described as a casino wagering game comprising 1) placing a single first wager to participate in the game; 2) a dealer dealing a hand of three cards to each player who placed a wager; 3) resolving the player hands against a plurality of predetermined winning poker outcomes; and 4) resolving each player's hand against a payout table providing payouts for predetermined ranks of poker-type hands; wherein at least some payouts proportional to the single part wager are available in resolving hands for obtaining a predetermined rank of hand. Predetermined winning poker outcomes that have proportional payouts pay odds. "Odds" in this context means payouts that are proportional to the player's wagers (that is, multiples of the wagers), not progressive payouts, fixed payout amounts or payouts that are part of or an entire pot.

According to an example of the present invention, the above-identified steps defines the entire game play method. In another example of the invention, an additional game segment or segments, optionally including a three card poker game against a dealer are also played with the same hand of cards. The predetermined winning outcomes can include a single face card, a pair or a higher ranking pair, depending upon the theoretical advantage to the house. When at least some of the outcomes pay odds, the odds may pay between 1:1 and 100:1 on the first single part wager. In another example of the invention, the house pays multiple payouts on the first wager. For example, the house may pay two separate payouts of up to 10:1.

Another aspect of the present invention includes a method of playing a casino card game utilizing a standard deck of cards, comprising the steps of: placing a wager to participate in a three card poker game against a dealer; dealing three cards to each player who placed a wager; dealing at least three cards to the dealer; and resolving the hands according to a predetermined hierarchy of poker hands. This game play sequence can be played as a stand-alone game, in combination with a three card hand against a pay table and/or other poker-style games. Preferably, the dealer also deals himself three cards. The players hand must outrank the dealer's hand in order to win the bet. Preferably, the dealer's hand must meet a minimum predetermined rank in order to qualify to play against the player. For example, the dealer must hold a Queen or better. Otherwise the bet is a push.

According to one aspect of the invention, the player is permitted to view his cards. He must then place an additional bet that his hand will beat the dealer hand or he must fold. The invention contemplates allowing the player to stay in the game if he opts not to make the additional bet. In one form of the invention, the player views his own three card hand and at least one dealer card before making the decision on whether or not to place the additional bet.

An optional feature of the invention is paying a bonus payout on either the bet, or the bet and additional bet (both against the dealer's hand) if the player's hand is one of a predetermined number of winning hands. For example, the player may receive a bonus payout when he has a straight flush. Preferably, no additional bet is required to collect on the bonus bet. In other examples of the invention, a bonus bet is required.

Although odds payouts on the bonus bet is a preferred form of the invention, certain high ranking hands may pay a fixed payout, a proportion of a pot or a progressive payout.

It might be necessary to distribute more than three cards to the dealer, and allow the dealer to use the extra card to make the best three card hand against the players. This dealing modification might be necessary to improve the house's odds, depending on the other game rules selected. The second bet and optional bonus bets may be required or optional, depending on house rules.

The present invention is also a method of playing a wagering game, comprising: a player placing at least one wager to participate in the game, wherein the player optionally places a first single part wager that his hand will contain one of a plurality of predetermined winning card combinations, a player optionally placing a second wager that his hand will contain a card combination higher in rank than a rank of a dealer hand; dealing three cards to the player; dealing, at least three cards to the dealer; and resolving the hands according to a predetermined hierarchy of poker hands. According to one aspect of the invention, the player may optionally play the game against the dealer, the game against a pay table or both during each round of play. In other examples of the invention, additional games are combined with one or more of the game segments (against the dealer and/or against a pay table). For example, the game rules could allow the player to place an additional bet on the occurrence of a five card hand against a pay table, where the dealer deals the player two additional cards after the three card hand against the dealer and/or against the pay table is complete. Although the specific type of additional game and the number of cards needed is unimportant to the invention, the use of the original three cards with or without adding more cards to play an additional game is contemplated by the invention.

When the three card game against the dealer is played, it is preferable that the dealer's hand meets a minimum value to qualify to play against the players. For example, the rules may require that the dealer hold a Queen or better to qualify. If the dealer's hand does not qualify, the third bet is returned to the player, and the second bet is paid 1:1. Alternatively, all bets made against the dealer are a push.

According to the invention, the game may be a player banked game, or a house banked game. When a player acts as banker, the house takes a flat fee from each player for each round of play, or takes a percentage of the amounts wagered, depending on the jurisdictional and house rules.

When the rules require the player to place a third wager to stay in the game against the dealer, the player is typically permitted to view his three card hand prior to making the third betting decision. In one example of the invention, the dealer turns one or more cards up prior to the player making the third betting decision. The third bet may be mandatory to stay in the game, or may be optional.

The dealer may also act as banker. The player's cards may be dealt unseen or seen. The cards preferably form a standard 52-card deck, although one or more wild cards (such as a joker(s)) may be used. The hand preferably consists of three cards, but in some instances, it might be desirable to deal either the players or the dealer one or more additional cards, and allow the player and/or dealer to discard to arrive at the best three card hand. In another example of the invention, players receive three cards, but have the option to discard one or more cards and have them replaced with additional cards, forming a three card "draw" hand.

A bonus payout may be awarded on the hand against the dealer, with or without requiring an additional bonus wager for certain predetermined poker hands. The bonus payouts may pay a fixed amount, odds, a, percentage of a pot or a progressive jackpot amount. Preferably, bonus amounts are paid without requiring a separate bonus wager according to an odds pay table.

In the case of one preferred three card version of the game, hands are preferably ranked as follows, where A=ace, K=king, Q=queen, J=jack and numbers 10 to 2 designate the other cards:

Highest:
- BRAG: Three cards of one suit in sequence
  - AKQ highest ranking brag
  - KQJ next highest ranking brag
  - QJ10 next highest ranking brag, and so on until
  - 32A lowest ranking brag
- TRIPS: Three cards of one Rank
  - AAA highest
  - KKK next highest ranking trips, and so on, until
  - 222 lowest ranking trips
- RUN: Three cards of mixed suits in sequence
  - AKQ highest ranking
  - KQJ next highest ranking, and so on, until
  - 32A lowest ranking
- FLUSH: Three cards of One Suit
  - AKJ highest
  - AK10 next highest, and so on, until
  - 532 lowest ranking
- PAIR: Two cards of Same Rank
  - AAK highest ranking
  - AAQ next highest ranking, and so on, until
  - 223 lowest ranking Lowest:
- HIGH CARD (a hand comprising none of the above combinations)
  - AKJ highest ranking
  - AK10 next highest ranking, and so on, until
  - 532 lowest ranking Ace is high, but can be low in 3-2-A Sequence.

Those skilled in the art will appreciate that various other names may be used for the hands in the illustrative hierarchy set forth herein. Other hierarchy's are contemplated. For example, BRAG may also be known as a royal flush (for AKQ), straight flush or bouncer; TRIPS may also be known as three of a kind or PRILE; and a RUN may also be known as a STRAIGHT.

The payout may be made in accordance with a predetermined scale. For example, one possible payout scheme is as follows:

| | | |
|---|---|---|
| Straight Flush | 40 to 1 | (Range of 25 to 100 to 1) |
| Three-of-a-kind | 30 to 1 | (Range of 10 to 50 to 1) |
| Straight | 6 to 1 | (Range of 4 to 12 to 1) |
| Flush | 4 to 1 | (Range of 3 to 12 to 1) |
| Pair | 1 to 1 | (Range of 1 to 3 to 1) |
| High Card Rank | 0.5 to 1 | (Range of 0.2 to 1 to 1) |

The payouts may be at different rates that are proportional to the original wager, but not necessarily whole number multipliers, such as 2 to 1 or 14 to 5 for a pair. Those skilled in the art will appreciate that the payouts may be varied without departing from the scope of the present invention. In other forms of the invention, at least some of the payouts are fixed in amount regardless of the amount wagered, are a percentage of a jackpot or progressive jackpot amount.

The method may further comprise the step of permitting or requiring a player to place a wager on a fixed or variable extra bonus jackpot, but this is a less preferred embodiment in some instances. For example, when a game is offered in a California card room, players bank the game. In order for players to feel they can afford to bank a particular game, the payout odds must be kept low enough to prevent players from avoiding their turn banking the game. The bonus payouts are therefore preferably eliminated in player-banked versions of the invention. Higher payout odds are acceptable in a more traditional Las Vegas style casino where the house banks the game.

Another embodiment of the present invention comprises the steps of: designating at least one playing card indicia as a wild indicia; placing a single part wager to participate in a casino three-card poker-type game; a dealer dealing a hand consisting of three cards to each player who placed a wager; and playing a three-card poker-type hand wherein said wild indicia is used where present in any of said hands; resolving each player's hand according to predetermined poker rules, wherein at least some payouts proportional to the single part wager are made for obtaining a predetermined winning hand.

In an alternative three-card embodiment of the present invention, each player receives two standard playing cards plus a wild card that the player combines with the standard cards to make a three-card hand. The payout scale and predetermined ranks may be chosen or modified to reflect the increased probability of a high ranking hand being produced. A common wild card or a common card may also be used, again with pay tables modified to reflect the increased potential or at least changed potential for higher ranked hands.

Such wild cards serve to add excitement and create higher hand values. Wild cards could also be designed to be retained permanently by players and if decorated appropriately by an issuing casino or the like would serve the dual purpose of a playing card and a promotional item. Wild cards may be used in this way in conjunction with other forms of card games. Alternatively, the wild card can be printed on the player area of the layout.

The invention also provides game apparatus for use in playing the card-type games of the present invention. For example, the games of the present invention are readily adaptable for play on a board game, computer game, or on a gaming device, such as a video gaming device. For example, one aspect of the present invention comprises an apparatus for playing a card-type game comprising: display element (e.g., board, screen, table cards, play sheet, etc.) for informing at least one player of a hierarchy of a plurality of possible hands and a predetermined plurality of winning card combinations; an area or position for receiving at least one wager selection from a plurality of wagering options by at least one player, wherein the wagering comprises whether a player's hand attains at least one of said predetermined plurality of winning combinations; and a surface or display area for displaying a plurality of indicia of playing cards to form at least one player's three-card hand.

According to a further aspect of the invention there is provided apparatus for use in playing a card game in which all possible hands of cards are ranked according to predetermined poker-type rules, the apparatus comprising at least one player's playing area, each player's playing area comprising a first zone in which a player may place a wager that the player's hand will be greater than a first predetermined rank, and a second zone for display of the player's hand.

The apparatus may also incorporate a chip tray to receive playing chips, the chip tray being placed in a position adjacent to or otherwise convenient to the dealer. The apparatus may also incorporate an area or receptacle for cards not in play and a shuffler and card shoe. The apparatus may comprise a rigid playing surface of board, plastic or other suitable material or may comprise a cloth or other flexible material defining a playing surface.

In a preferred form, the surface is of generally semi-circular form, the dealer's playing area being located proximate the straight edge of the playing surface or centrally thereof and the players'playing areas being disposed side-by-side in arcuate array adjacent the curved edge of the playing surface.

The various embodiments of the present invention are directed to three-card poker-type games wherein indicia of playing cards are displayed to at least one or more players. As used herein, the phrase "indicia of playing cards" is meant to include actual playing cards, as well as images of playing cards displayed either mechanically, electro-mechanically, electronically or otherwise. For example, it is well within the scope of the present invention to display indicia of playing cards on an actual board game, on a mechanical slot machine, on an electronic gaming device, on another video screen, on video displays at individual player positions (with cards generated by a random selection device, such as a random number generator associated with a set of visual data of card elements) or utilizing another form of image generation such as holography. Similarly, the phrase "indicia of wild cards" as used herein may include jokers from a standard deck of playing cards but may also comprise other indicia that, according to rules of the game, may be used for at least one other value.

FIG. 1 shows a playing surface or table layout 10 on which one or more embodiments of the present invention may be played. Either the game against the dealer alone, a game against the pay table alone or both (either with both segments optional or mandatory) may be played on the exemplary layout. The layout 10 may be marked or placed on any suitable surface such as a gaming table. For example, the layout may be in the form of a layout cloth supported on a. supporting surface. The layout provides a playing area 12 for a plurality of players, for example seven players, and a separate area 14 for the dealer. Each playing area 12 has a marked section or zones 16 for the placing of the first wager by a player as will be described hereinafter.

Each player takes a place at one of the areas 12. The game is played as a round as will be described below. In an example of the invention that includes the player placing a bet against a pay table, each player wagers that the rank of his hand will exceed a minimum predetermined value. On one example, the minimum value is a pair. The game can be played with a standard 52-card deck, or a modified deck, such as a deck with the lower ranking cards (2's, 3's, 4's and 5's) stripped out, for example. At the commencement of the game, each player decides whether to play the particular round by wagering against the "PAIR PLUS" (the first) wager. "PAIR PLUS" is a designation meaning that the poker ranking of the hand must include a pair or better. The gaming chips used in the Pair Plus wager may be of any conventional kind and are available in a number of denominations such as are well known within the art. If the player wishes (alternatively or in addition) to make a wager based on the value of his hand, he places an appropriate token or chip on PAIR PLUS section 16 of his playing area 12. In the present example, the rules of the game provide that payouts will be made according to a displayed payout schedule with "PAIR PLUS" payouts starting at a pair or better. In a preferred three-card version of the game, hands are preferably ranked according to the following hierarchy, though other rankings may be used:

Highest:
- BRAG: Three of one suit in sequence
  - AKQ highest ranking brag
  - KQJ next highest ranking brag
  - QJ10 next highest ranking brag, and so on until
  - 32A lowest ranking brag
- TRIPS: Three of One Rank
  - AAA highest
  - KKK next highest ranking trips, and so on until
  - 222 lowest ranking trips
- RUN: Three of mixed suits in sequence
  - AKQ highest ranking,
  - KQJ next highest ranking, and so on, until
  - 32A lowest ranking
- FLUSH: Three of One Suit
  - AKJ highest
  - AK10 next highest, and so on, until
  - 532 lowest ranking
- PAIR: Two of Same Rank
  - AAK highest ranking
  - AAQ next highest ranking, and so on, until
  - 223 lowest ranking Lowest:
- HIGH CARD (a hand comprising none of the above)
  - AKJ highest ranking
  - AK10 next highest ranking, and so on, until
  - 532 lowest ranking ACE is high, but can be low in 3-2-A Sequence The payout schedule may be varied in accordance with rules of the game and/or by the casino. For example, one preferred payout schedule is as follows:

| | |
|---|---|
| Straight Flush | 40 to 1 |
| Three-of-a-kind | 30 to 1 |
| Straight | 6 to 1 |
| Flush | 4 to 1 |
| Pair | 1 to 1 |

Alternatively, in a gaming establishment or jurisdiction where high odds payouts are not favored, a wager can be made solely that the value of the hand will be a pair or greater, King high or greater, Queen high or greater, and the like, and the payout may be, for example, 14 to 5, or whatever other payout is found to be appropriate or desirable.

The display area 22 may include a pay table that appears on the playing surface 12, on a "how to play" card (also known as a "rack card"), or on a plaquard within the view of the players. It is also desirable to position the pay tables proximate the dealer to assist the dealer in resolving the hands. In an alternative arrangement, details of payouts and any extra bonus payouts may be marked on separate displays, such as vertical or supported signs on the table top.

When the above wager is in place on area 16, the dealer preferably shuffles the cards (manually or with an automated shuffling apparatus) and then deals a three-card hand to each player and to himself. The cards may initially be dealt to the players face up or face down, depending upon casino policy.

"PAIR PLUS" wagers are not affected by player inspection. A player playing "PAIR PLUS" only, places his cards in the playing area. If the player reveals a pair or greater to the dealer, with either the dealer or the player exposing the player's cards, the player will be paid appropriately for the wager. Players who have wagered on the value of the hand (i.e., PAIR PLUS wagers) win if the hand is at least a pair, and are paid by the banker according to the posted scale. These payouts are independent of any other potential play with the cards or continued play with additional cards. This procedure completes a single round of the game, when only the PAIR PLUS bet is played. Play then continues in another round, with players commencing by making additional PAIR PLUS wagers.

According to another aspect of the invention, when the player wishes to make a bet against the dealer, either with or without making the PAIR PLUS bet, he places a wager in the "ANTE" area 18. In the following example, the player is playing only the ANTE bet, and is not participating in the PAIR PLUS game. The player places the ANTE, and then receives three cards. The dealer also deals himself three cards. The player is permitted to view his cards prior to determining whether to make an additional "PLAY" bet in area 20, or fold. In another example of the invention, the player can opt not to make the PLAY wager and remain in the game. In yet another example, the dealer reveals one or more cards to the player, and this information in combination with the knowledge of the player's hand is used to determine whether the PLAY bet should be made.

In a preferred form of the invention, the dealer's hand must meet a minimum ranking in order to qualify to play against the players. In one example, the dealer must have a hand of a Queen or better, otherwise the play wager is returned, and the ante is paid 1:1. In another example, when the dealer does not qualify, both the ANTE and PLAY bets are returned to the player. When the dealer's hand qualifies, the player's hand must beat the dealer's hand in order to win the Ante and Play bets. In a preferred form of the invention, the ante and play bets are paid 1:1 when the player's hand outranks the dealer's hand.

In the examples outlined above, only the PAIR PLUS or the ANTE/PLAY (or ANTE) betting options are permitted from round to round. In other words, the game can be played in a PAIR PLUS only format or in a ANTE/PLAY or ANTE only format. In another example, both betting options are permitted within the same game, and the player has the option of playing one, or the other, or both on any given round. Alternatively, both the PAIR PLUS and ANTE/PLAY (or ANTE) may be required in each round of play. In yet other examples, the PAIR PLUS and ANTE/PLAY or ANTE can be individually or together, in combination with additional games that utilize the three card poker hand to play additional games. For example, the player might make the PAIR PLUS bet and additional bet on a five card stud game. At the conclusion of the PAIR PLUS three card game, the dealer gives the player two more cards to play a hand of five card poker. The number of cards and the specific subsequent game are unimportant to the invention. What is important is that the cards originally dealt be used in a subsequent segment of play. The player can also make an ANTE/BET wager and a five card stud wager, or both the ANTE/BET and PAIR PLUS wager and five card stud wager. As with the example of the invention described above that describes the ANTE/BET wagering embodiment, a bonus payout as shown in pay table 26 may also be provided for awarding the player for a predetermined high ranking poker hand against the dealer.

The novel methods of the present invention may be played utilizing playing cards as illustrated above, or on an electrical or electromechanical device such as a gaming machine. Those skilled in the art will appreciate that suitable controls can be provided for receiving the necessary input and therefore will not be described in detail herein. While the gaming device is intended for play by a single player against the playing device, it is also within the scope of the present invention to provide a multi-unit video format wherein a plurality of players may play against each other and/or against a dealer. Similarly, from the present description, those skilled in the art will appreciate that the novel games of the present invention are readily adaptable for play either within a gaming establishment or at a remote location, such as on a terminal provided in a commercial aircraft or in a hotel room within a casino, for example. Furthermore, the game is readily adaptable to a scratch card format.

From the present description, those skilled in the art will appreciate that various modifications may be made without department from the scope of the present invention. For example, the naming of the wagers, the naming and/or ranking of any hand, the payout schedule and predetermined winning or losing ranks may be varied in accordance with the requirements of the casino. The table layout may be varied from that described and shown. The rules may be varied, or additional rules imposed, within the scope of the invention.

In particular, there may be introduced a further option of a player wagering on a high odds payout wager or on a fixed or variable jackpot which is paid out in accordance with rules of the casino on a premium hand, or when a high ranked hand is beaten by the dealer. Examples of odds available could be 5000 to 1 or more against a royal flush—ace, king, queen suited or up to 250,000 to 1 or more against consecutive straight flushes.

If the game incorporates a jackpot or a numerical hand value wager, separate designated wagering areas may be provided for these wagers. These may be incorporated at any convenient position on the players' playing areas. The display stand, the wild and promotional card may also be modified or omitted as desired. Whilst the game is described particularly for play in a gaming establishment, it is not limited in this respect and may also be played for example in a domestic environment or in the format of a video game, slot machine, parlor game, lottery-style game or the like.

What is claimed is:

1. A method of playing a wagering game, comprising:

placing a first single part wager to participate in a casino three-card poker-type game;

a dealer dealing a hand consisting of three cards to each player who placed a first wager; and resolving each player's three card hand according to a predetermined hierarchy of poker hands.

2. The method of claim 1, wherein a payout is made to the player on the first wager for one of a plurality of predetermined winning outcomes.

3. The method of claim 2, wherein payouts on the first wager for at least one of the plurality of predetermined winning outcomes is made in proportion to an amount wagered.

4. The method of claim 2, wherein the hands are resolved according to a pay table that pays a proportional payout on the first bet for each predetermined winning outcome.

5. The method of claim 4 wherein the proportional payouts include possible payouts of between at least 1 to 1 and 100 to 1 against the single part wager.

6. The method of claim 2, wherein the hands are resolved according to a pay table on the first bet, and wherein the method of payment is selected from the group consisting of a fixed payout, a proportional payout, a percentage of a progressive pot or a progressive jackpot amount.

7. The method of claim 2 wherein the predetermined winning outcome is at least one face card.

8. The method of claim 2 wherein the predetermined winning outcome is at least one pair.

9. The method of claim 1 further comprising the player placing a second wager to participate in a game against the dealer, wherein the dealer also receives a hand of at least three cards.

10. The method of claim 9, wherein the second wager and participation in the game against the dealer is optional.

11. The method of claim 9, wherein the second wager and participation in the game against the dealer is mandatory.

12. The method of claim 9, wherein both the first and second wagers are mandatory.

13. The method of claim 9, wherein the game is player banked.

14. The method of claim 9, wherein the player is required to place a third wager after viewing his hand to stay in the game against the dealer.

15. The method of claim 9, wherein the player has an option to place a third wager after viewing his hand, and may stay in the game even if he does not place a third wager.

16. The method of claim 9, wherein the dealer's hand must meet a predetermined minimum rank in order for the player to be paid on the bet against the dealer.

17. The method of claim 16 wherein the predetermined rank of a hand is at least one face card.

18. The method of claim 16 wherein the predetermined rank of a hand is at least one pair.

19. The method of claim 9, wherein the dealer reveals at least one dealer card before the player decides whether to place a third bet against the dealer.

20. The method of claim 1, wherein the game is player banked.

21. A method of playing a live casino table card game with physical cards comprising:

placing a single part wager to participate in a casino wagering three-card poker-type game;

dealing a hand consisting of three cards to each player who placed a single part wager; and resolving each player's hand according to the rules of poker against a payout table providing payouts for predetermined ranks of poker-type hands;

wherein at least some payouts proportional to the single part wager are available in resolving hands for obtaining a predetermined rank of a hand.

22. The method of claim 21, consisting essentially of:

placing a single part wager to participate in a casino wagering three-card poker-type game;

dealing a hand consisting of three cards to each player who placed a single part wager; and resolving each player's hand according to the rules of poker against a payout table providing payouts for predetermined ranks of poker-type hands;

wherein at least some payouts proportional to the single part wager are available in resolving hands for obtaining a predetermined rank of a hand.

23. The method of claim 21 wherein the proportional payouts include possible payouts of between at least 1 to 1 and 100 to 1 against the single part wager.

24. The method of claim 23 wherein the proportional payouts include at least two possible payouts of at least 10 to 1.

25. A method of playing a casino card game utilizing a standard deck of cards, comprising the steps of:

placing a wager to participate in a three card poker game against a dealer;

dealing three cards to the player;

dealing at least three cards to the dealer; and resolving the hands according to a predetermined hierarchy of winning poker hands.

26. The method of claim 25, wherein the dealer's hand must meet a minimum predetermined value in order for the player to receive a payout on the wager.

27. The method of claim 25, wherein the player is paid a payout on the wager if a rank of his hand beats a rank of the dealer hand.

28. The method of claim 25, and further comprising the step of the player making a second wager against the dealer's hand or folding.

29. The method of claim 28, wherein the dealer shows the player one of his cards prior to the player making a second wager.

30. The method of claim 28, wherein the dealer's hand must meet a minimum value in order for the player to be paid on either the wager or the second wager.

31. The method of claim 30, wherein the minimum value is a queen or better.

32. The method of claim 25, and further comprising the step of the player optionally making a second wager against the dealer's hand, and staying in the game regardless of whether the second wager is made.

33. The method of claim 25, wherein a bonus payout is made if the player's hand is one of a plurality of predetermined winning hands.

34. The method of claim 33, wherein the bonus payout is selected from the group consisting of a fixed payout, an odds payout, a portion of a jackpot or a jackpot amount.

35. The method of claim 25, wherein the dealer receives three cards.

36. The method of claim 25, and further comprising the step of placing a second wager upon the occurrence of one of a predetermined number of winning poker combinations.

37. The method of claim 36, wherein the second wager is optional.

38. The method of claim 36, wherein the wager and second wagers are mandatory.

39. A method of playing a wagering game, comprising:

a player placing at least one wager to participate in the game, wherein the player optionally places a first single part wager that his hand will contain one of a plurality of predetermined winning card combinations;

a player optionally placing a second wager that his hand will contain a card combination higher in rank than a rank of a dealer hand;

dealing three cards to the player;

dealing at least three cards to the dealer; and resolving the hands according to a predetermined hierarchy of poker hands.

40. The method of claim 39, wherein the player betting steps are selected from the group consisting of the player placing the first wager only, the player placing the second wager only and the player placing the first and second wager.

41. The method of claim 39, and further comprising the player placing at least one additional bet on an additional wagering game utilizing at least a portion of the player's three card hand.

42. The method of claim 41, wherein the additional wagering game is five card poker, and the player receives two additional cards.

43. The method of claim 39, wherein the dealer's three card hand must be of a minimum predetermined ranking in order for the player to win the second wager against the dealer's hand.

44. The method of claim 39, wherein the game is player banked.

45. The method of claim 39, wherein the game is house banked.

46. The method of claim 39, wherein the player must make a third wager in order to stay in the game against the dealer's hand.

47. The method of claim 46, wherein the dealer reveals at least one card prior to the player making the third wager.

48. The method of claim 39, wherein the player may optionally make a third wager against the dealer's hand and stay in the game regardless of whether the third wager is made.

* * * * *